US011085633B2

(12) United States Patent
Glover

(10) Patent No.: US 11,085,633 B2
(45) Date of Patent: Aug. 10, 2021

(54) NOZZLE WITH INSULATING AIR GAP AND SEAL TO CLOSE THE GAP

(71) Applicant: ROLLS-ROYCE plc, London (GB)

(72) Inventor: Mark Glover, Derby (GB)

(73) Assignee: ROLLS-ROYCE plc, London (GB)

( * ) Notice: Subject to any disclaimer, the term of this patent is extended or adjusted under 35 U.S.C. 154(b) by 199 days.

(21) Appl. No.: 16/248,002

(22) Filed: Jan. 15, 2019

(65) Prior Publication Data

US 2019/0249869 A1 Aug. 15, 2019

(30) Foreign Application Priority Data

Feb. 9, 2018 (GB) ..... 1802105

(51) Int. Cl.
*F23D 11/38* (2006.01)
*F23R 3/28* (2006.01)

(52) U.S. Cl.
CPC ..... *F23D 11/383* (2013.01); *F23R 3/283* (2013.01); *F23R 2900/00004* (2013.01); *F23R 2900/00005* (2013.01); *F23R 2900/00012* (2013.01)

(58) Field of Classification Search
CPC ..... F05D 2240/58; F05D 2240/581; F23D 11/38; F23D 11/383; F23D 14/24; F23D 14/48; F23R 3/14; F23R 3/283; F23R 3/286; F23R 3/343; F23R 2900/00012
See application file for complete search history.

(56) References Cited

U.S. PATENT DOCUMENTS 5,761,907 A 6/1998 Pelletier et al.
5,771,696 A * 6/1998 Hansel ..... F23D 23/00 60/739
6,877,306 B2 * 4/2005 Wernberg ..... F02C 7/232 60/39.094
8,015,815 B2 9/2011 Pelletier et al.
8,196,845 B2 6/2012 Thomson et al.
8,240,151 B2 8/2012 Pelletier et al.
2010/0307161 A1 * 12/2010 Thomson ..... F23R 3/28 60/748
2012/0204571 A1 * 8/2012 Kraemer ..... F23D 14/48 60/776
2014/0116066 A1 * 5/2014 Melton ..... F23D 11/36 60/806
2016/0265778 A1 * 9/2016 Patel ..... F23R 3/28
2019/0055853 A1 * 2/2019 Smedresman ..... F01D 25/183
2019/0186750 A1 * 6/2019 Prociw ..... F23D 17/002

FOREIGN PATENT DOCUMENTS

WO 09039142 A2 3/2009

OTHER PUBLICATIONS

Jul. 20, 2018 Great Britain Search Report issued in Patent Application 1802105.5.

* cited by examiner

*Primary Examiner* — Scott J Walthour
(74) *Attorney, Agent, or Firm* — Oliff PLC

(57) ABSTRACT

A nozzle for a fuel injector of a gas turbine engine, the nozzle having an insulating air gap adjacent a conduit for carrying fuel, the air gap formed between a pair of concentrically arranged annular walls, wherein the pair of annular walls are arranged to move independently to accommodate differential thermal expansion, the nozzle further including: a channel extending circumferentially around a surface a first of the pair of annular walls, facing a second of the pair of annular walls; and a sealing member received in the channel, to close the insulating gap.

16 Claims, 4 Drawing Sheets

NOZZLE WITH INSULATING AIR GAP AND SEAL TO CLOSE THE GAP

The present disclosure concerns a nozzle for a fuel injector of a gas turbine engine and a fuel injector for a gas turbine engine.

Fuel injectors in gas turbine engines operate in harsh thermal environments, with ambient temperatures often exceeding heats at which aviation fuel degrades. When aviation fuel degrades, it can leave a carbon lacquer deposit, which can fully or partially block fuel supply pipes, reducing engine performance and lifetime. To overcome this, fuel injectors are often provided with heat shielding. At the operating temperatures within a turbine engine, the supports for mounting the injector and the housing of the injector can expand by 1 mm or more, whilst the fuel supply pipes, which are kept at lower temperatures by the heat shielding, do not expand (or expand by less).

This differential expansion can cause mechanical stress. Typically, in order to accommodate this, a slip fit is formed in the nozzle of the injector, between the housing/heat shielding of the injector and the internal structures of the injector.

According to a first aspect there is provided a nozzle for a fuel injector of a gas turbine engine, the nozzle having an insulating air gap adjacent a conduit for carrying fuel, the air gap formed between a pair of concentrically arranged annular walls, wherein the pair of annular walls are arranged to move independently to accommodate differential thermal expansion, the nozzle further including: a channel extending circumferentially around a surface a first of the pair of annular walls, facing a second of the pair of annular walls; and a sealing member received in the channel, to close the insulating gap.

The nozzle provides for an active means of sealing the insulating air gap, preventing ingress of fuel into the gap. This would, eventually, reduce injector performance or result in a critical failure of the injector. Furthermore, the use of a sealing member makes the injector simple to make, and to repair, when necessary, because the sealing member is retained in a channel rather than physically connected to any part of the nozzle.

The sealing member may be biased towards the second of the pair of annular walls. This ensures a good seal is formed, closing the insulating air gap.

The sealing member may include a split extending between an outer circumferential edge and an inner circumferential edge.

The nozzle may include an outer wall having a radial outer face forming an exterior surface of the nozzle and a radial inner face opposing the outer face. The nozzle may also include an annular heat shield concentrically within the outer wall and having a radial inner face adjacent the fuel conduit and a radial outer face opposing the inner face and facing the outer wall. The insulating air gap may be formed between the inner face of the outer wall and the outer face of the heat shield.

The fuel conduit may comprise a radial inner face concentrically within the annular heat shield. The nozzle may further include an air swirler concentrically within the fuel conduit and having a radial outer face, facing the inner face of the fuel conduit. A second insulating air gap may be formed between the inner face of the fuel conduit and the outer face of the air swirler. A second channel may extend around a surface of one of the inner face of the fuel conduit and the outer face of the fuel swirler; and a second sealing member may be received in the channel, to close the second insulating gap.

The fuel conduit may comprise a radial inner face, and the nozzle may further include an air swirler concentrically within the fuel conduit and having a radial outer face, facing the inner face of the fuel conduit. The insulating air gap may be formed between the inner face of the fuel conduit and the outer face of the air swirler.

One of the pair of annular walls may be adjacent the fuel conduit. The other of the pair of annular walls may include an aperture extending through the annular wall. The aperture may be provided axially behind the sealing member, to form a pressure differential over the seal. The aperture is open to high pressure regions of the engine, and the pressure differential helps to prevent fuel entering the insulating air gap.

The nozzle may include a pair of axially spaced annular circumferential projections extending from first of the pair of annular walls. The channel may be formed between the projections.

The nozzle may include: a feed arm for supplying fuel to the nozzle. A feed arm support housing may form an exterior surface of the feed arm and a radially rearward portion of the nozzle. The sealing member may be provided axially forward of the feed arm housing.

The sealing member may comprise a piston ring type seal.

The pair of annular walls may be formed of a first material, and the sealing member may be formed of a second material, less resistant to wear than the first material. This promotes wear on the sealing ring, which is replaceable, rather than the body of the nozzle.

According to a second aspect, there is provided an in or having a nozzle according to the first aspect.

The injector includes an active means of sealing the insulating air gap, preventing ingress of fuel into the gap. This would, eventually, reduce injector performance or result in a critical failure of the injector. Furthermore, the use of a sealing member makes the injector simple to make, and to repair, when necessary, because the sealing member is retained in a channel rather than physically connected to any part of the nozzle.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Embodiments will now be described by way of example only, with reference to the Figures, in which.

Figure 1:
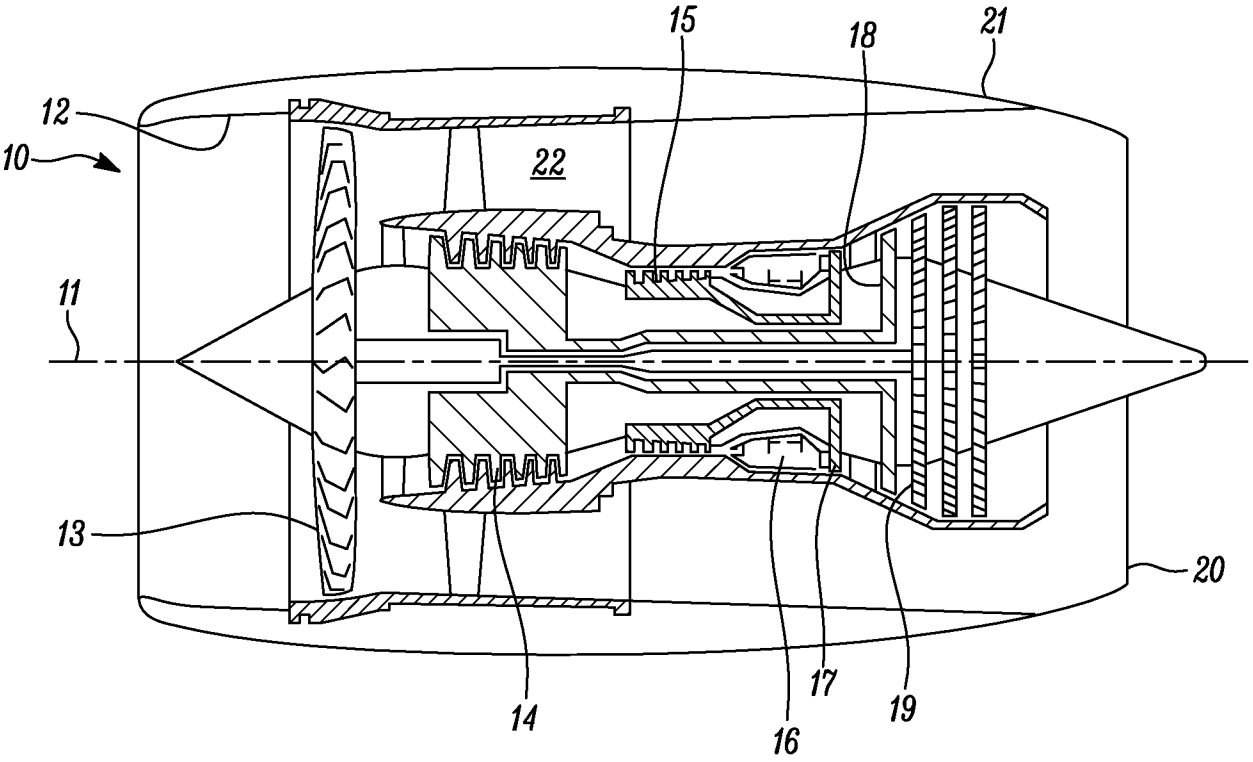
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
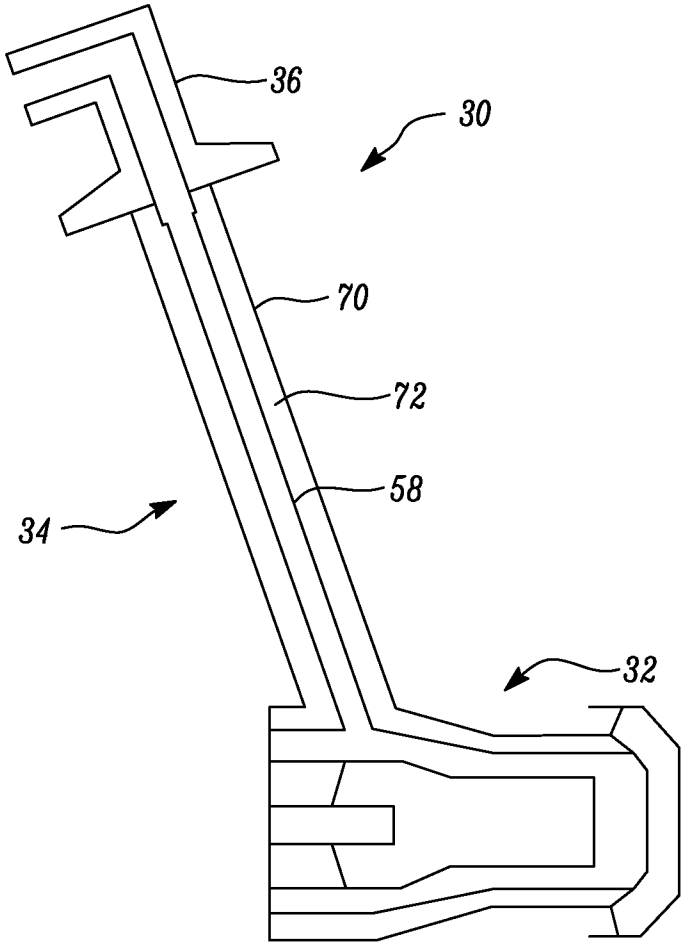
FIG. 2 is a schematic cut-through view of a fuel injector for a gas turbine engine.

In a gas turbine engine 10, fuel is delivered from a reservoir or store (not shown) to the combustion equipment 16 through a fuel distribution system (not shown). The combustion equipment 16 includes a chamber (not shown) where fuel is combusted in air from the compressor stages 14, 15. Fuel is directed into the combustion chamber through one or more fuel injectors 30. FIG. 2 illustrates a schematic example of a fuel injector 30.

The fuel injector 30 includes a feed arm 34 and a nozzle head 32. The feed arm 34 delivers fuel from the distribution system to the nozzle head 32, and the nozzle head 32 is for mixing fuel with air from the compressor stages 14, 15 and delivering the mixture into the combustion chamber as an atomised spray.

The feed arm 34 includes a connector 36 and a fuel pipe 58. The connector 36 couples the injector 30 to the fuel distribution system and the fuel pipe 58 extends between the connector 36 and the nozzle head 32, to deliver the fuel to the nozzle head 32.

Figure 3:
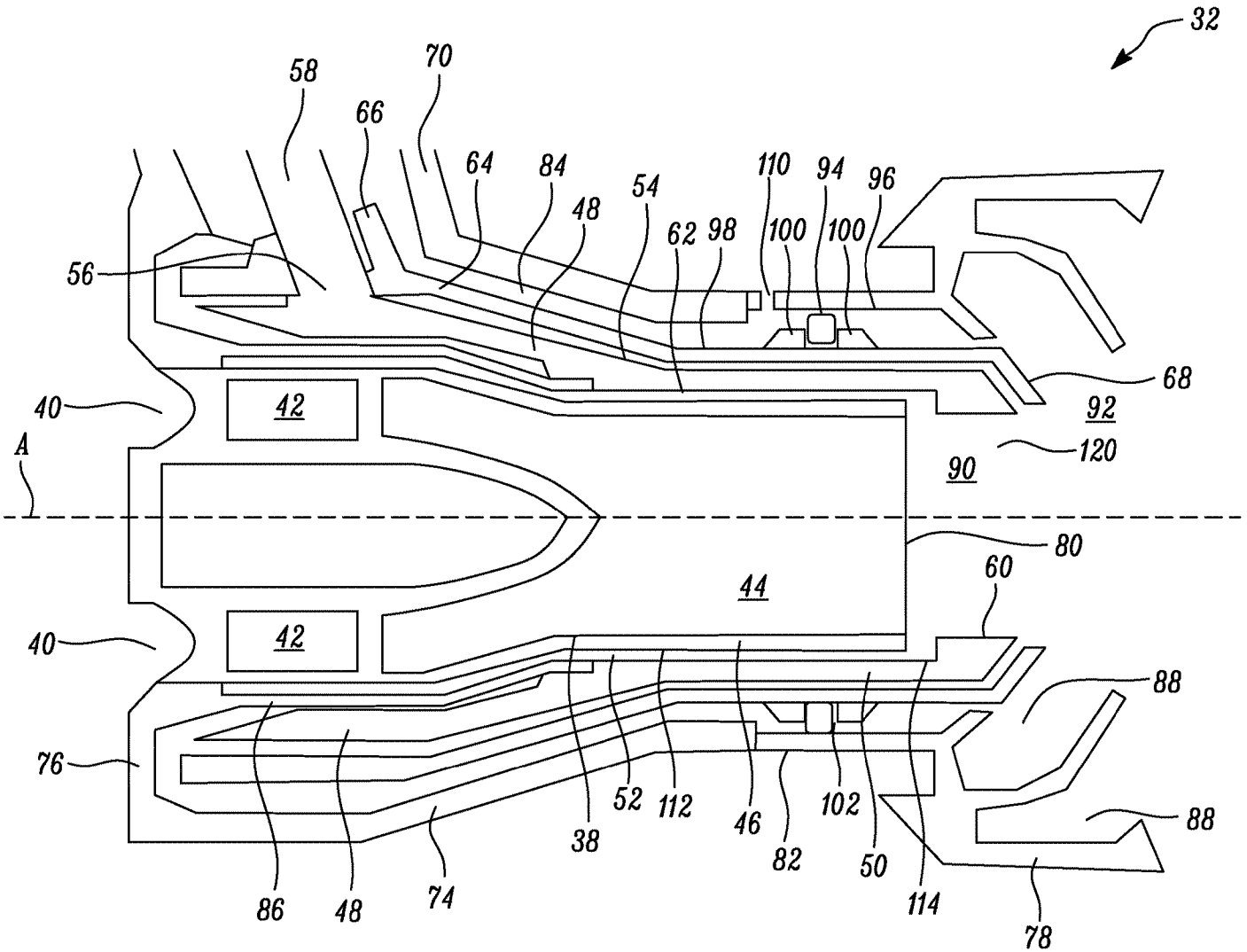
FIG. 3 is a schematic cut-through view of a nozzle of the injector of FIG. 2.

FIG. 3 illustrates the nozzle 32 of the fuel injector 30 in more detail. The nozzle 32 is arranged around a central axis, shown by dashed line A. An inner air swirler 38 extends along the central axis A. The inner air swirler 38 has an outer wall 46 extending circumferentially around and axially along the axis A. The outer wall 46 defines an interior space of the swirler 38. Inlets 40 extend into the interior at an axially rearward and of the injector 30. The inlets 40 extend into feed channels 42 which extend axially forward, to a single combined channel 44 which ends in an outlet 80. The air channels 42, 44 include baffles (not shown) to impart turbulence to the air passing through the swirler 38.

A fuel swirler 48 is arranged radially outside the inner air swirler 38, extending circumferentially around and axially along the axis A. The fuel swirler 48 includes a fuel channel 50 defined between an inner wall 52 and an outer wall 54. The fuel swirler 48 is spaced from the inner air swirler 38, so that an air gap 62 is formed between the inner wall 52 of the fuel swirler 48 and the outer wall 46 of the inner air swirler 38. The air gap 62 extends circumferentially around and axially along the axis A.

The channel 50 in the fuel swirler 48 extends from an inlet 56, coupled to the fuel pipe 58, to an outlet 60 axially in front of the outlet 80 of the inner air swirler 38. The fuel swirler 48 also include baffles (not shown) to impart turbulence to the fuel passing through the channel 50. The channel 50 of the fuel swirler 46 and/or the fuel pipe 58 form a conduit for carrying the fuel.

Radially outside the fuel swirler 46, is an outer heat shield 64. The outer heat shield extends circumferentially around the fuel swirler 48, and along the axial length of the fuel swirler 46. The outer heat shield 64 also include a first radially extending portion 66 extending up a portion of the length of the fuel tube 56, and a second radially extending portion 68 extending in front of the fuel swirler 48, towards the axis A, defining an outlet 120.

As best shown in FIG. 2, the feed arm 34 includes a housing 70 arranged around the fuel pipe 56. The housing 70 is spaced from the fuel pipe 58 to form an air gap 72 between the fuel pipe 58 and the housing 70. As shown in FIG. 3, the housing 70 includes an axially extending portion 74 extending axially along a portion of the length of the nozzle 32, and a rear portion 76 extending along the rear of the nozzle 32 to define the inlets 40 of the inner air swirler 38.

An outer air swirler 78 is provided at an axially forward end of the nozzle 32. The outer air swirler 78 includes a number of additional air channels 88, having baffles (not shown) to impart turbulence to the air passing through them. The outlets 84 of the channels 88 are provided axially in front of the outlet 80 of the inner air swirler 38, the outlet 60 of the fuel swirler 48, and the outlet 120 defined by the outer heat shield 64.

The outer air swirler 78 includes a housing portion 82 which extends parallel to the outer heat shield 64, and extends rearwards to meet the feed arm housing 70. The axially extending portion 74 of the feed arm housing 70 and the housing portion 82 of the outer air swirler 78 define a nozzle housing, extending around the nozzle 32.

The axially extending nozzle housing 74, 82 is spaced from the outer heat shield 64, so that an air gap 84 is formed. The axially extending nozzle housing 74, 82 has an outer face, forming an exterior of the injector 30, and a radially opposed inner face 96 facing the air gap 84. Similarly, the heat shield has an outer face 98 facing the air gap 84 and a radially opposing inner face, facing the fuel swirler 48.

The nozzle head 32 also includes an inner heat shield 86. The inner heat shield extends from the rear portion 76 of the fuel pipe housing 70, forward and around the inner air swirler 38, in the gap 62 between the inner air swirler 38 and the fuel swirler 48. The inner heat shield 86 only extends along a portion of the length of the inner fuel swirler 38. In the region where the inner heat shield is provided, the spacing between the inner air swirler 38 and the fuel swirler 48 is larger than in the region forward of the inner heat shield 86.

In use, air from the compressor stages 14, 15 is passed through the inner air swirler 38. At a first mixing region 90, air from the inner air swirler 38 is mixed with fuel from the fuel swirler 48 to form a sheet of atomised fuel. Additional air from the compressor stages 14, 15 is fed through the channels 88 of the outer air swirler 78, and mixed in a second mixing region 92, from where the fuel/air mixture is directed into the combustion chamber.

In use, the injector 30 is mounted to a casing of the combustor and is mounted from further support structures (not shown) in the region of the connector 32. The general environment of the support structures is high temperature, in excess of 600° C. The air passing through the inner and outer air swirler 38, 78 is also at such high temperatures.

If the temperature of the fuel exceeds 200° C., the fuel can degrade. This can leave carbon deposits which restrict or block the fuel conduit, causing reduction in performance, or failure, or the injector. The heat shield 64, 86 and air gaps 62, 72, 84 provide insulation for the fuel supply in the fuel conduit. However, as a result of this heat shielding, some components (such as the fuel pipe 58, outer heat shield 64 and fuel swirler 48) are at different temperatures to others (such as the outer housing 70, 82 and support structures). This means different components undergo different amounts of thermal expansion.

In order to accommodate this differential expansion, the fuel pipe 58 can be arranged to expand, for example by using an expanding spiral structure, or slip fits at one end of the pipe. In order to accommodate differential thermal expansion in the nozzle head 32, the outer heat shield 64 is mounted in a slip fit relative to the nozzle housing 74, 82, so that the two parts can slide relative to each other as they expand. Similarly, the inner air swirler 38 is mounted in a slip fit relative to the fuel swirler 48.

To prevent ingress of fuel or other deposits into the insulating air gap 84 between the outer heat shield 64 and the housing 74, 82, a seal 94 is provided. The seal 94 is an annular piston-ring type sealing element, that extends around the axis A and forms a seal between the pair of annular walls formed by the heat shield 64 and the nozzle housing 74, 82. The seal has a circular cross section, and is formed of a resiliently deformable material that is able to form a tight seal between the inner face 96 of the housing 74, 82 and the outer face 98 of the outer heat shield 64. The material of the seal should also be selected to minimise wear on the nozzle head. Therefore, the seal 94 should be formed of a material less resistant to wear than the heat shield 64 and housing 74,82. For example, the seal 94 may be formed of materials such as stainless steel or nickel superalloys. In some examples, the seal 94 may be Hast X, Inco 625, Inco 718, Haynes 230, Haynes 282.

The seal 94 is provided at or near the axially forward end of the air gap 84, to prevent ingress of fuel or deposits into any part of the air gap 84. As such, the sealing element 94 forms a seal with the housing portion 82 of the outer air swirler 78.

As shown in FIG. 3, a pair of axially spaced projections 100 are formed on the outer face 98 of the outer heat shield 64. The projections 100 are annular and extend around the circumference of the outer heat shield 64. Between the projections a channel 102 is defined. The seal 94 is received in the channel 102. The axially spaced projections 100 should also be formed of a material more resistant to wear than the seal 94. In some examples, the axially spaced projections 100 are formed of the same material as the heat shield 64.

Figure 4C:
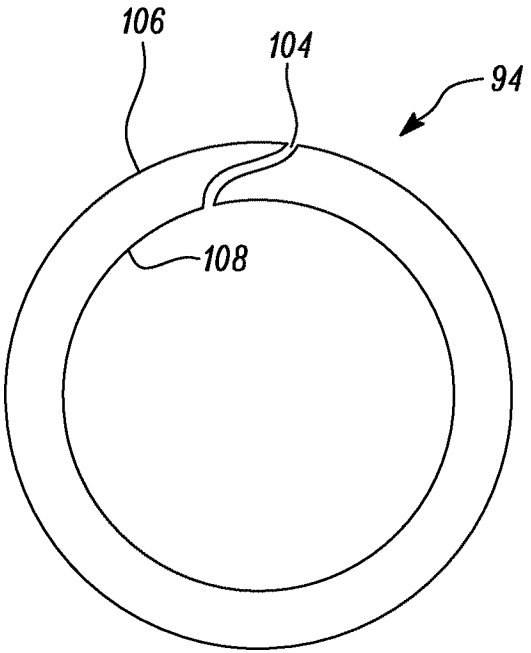
FIGS. 4A to 4C are schematic front views of examples of seals for use in the nozzle of FIG. 3.
Figure 4B:
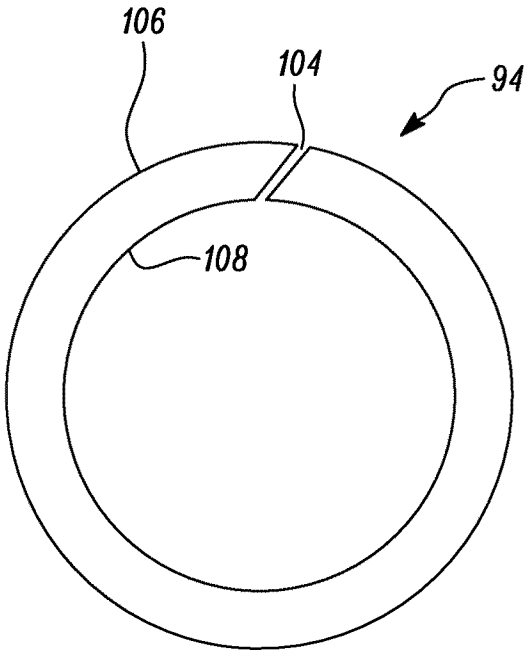
Figure 4A:
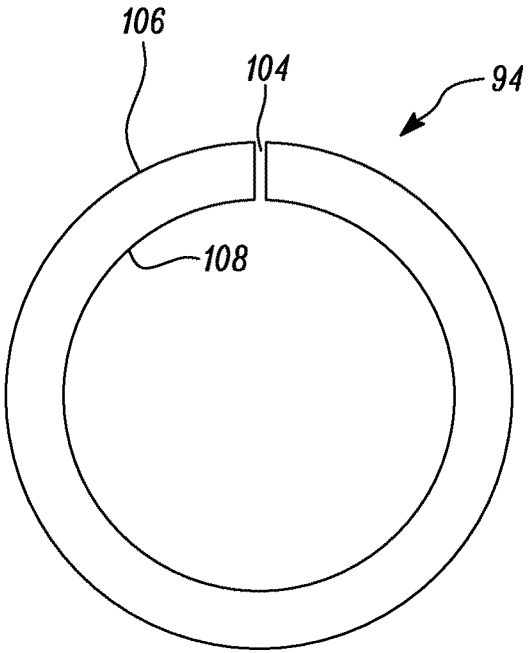

The seal 94 includes a split 104 around its circumference such that it provides an outward pressure away from the channel 102, towards the inner face 96 of the housing 74, 82. The split 104 extends from an outer radial face 106 of the seal 94 to an inner radial face 108. FIGS. 4A to 4C show examples of different types of split 104 that may be used.

In the example shown in FIG. 4A, the split 104 is a simple radially extending straight split. In the example shown in FIG. 4B, the split 104 is a straight split, extending at an angle to the radius of the seal. In the example shown in FIG. 4C 104, the split 104 follows a curved path. It will be appreciated that any type of split may be used, and the splits shown in FIGS. 4A to 4C are given by way of example only.

An aperture 110 is provided through the nozzle housing 74, 82, in a position axially behind the seal 94. In use, the air outside the injector 30 is at higher pressure than the air inside the insulating air gap 84, and at higher pressure than the air in the axially forward end of the nozzle 32. As such, the aperture 110 opens the air gap 84 to air pressure, and creates a pressure differential over the seal 94. This pressure differential further acts to prevent ingress of fuel and other deposits.

In one example, the aperture 110 may be 0.5 mm in diameter. However, in other examples, the aperture 110 may be between 0.1 mm and 2 mm in diameter, in order to achieve an appropriate pressure differential, without allowing ingress of hot air.

The use of an aperture 110 to provide a pressure differential is optional, and may be omitted.

A second seal (not shown) may be provided in the air gap 62 formed between the fuel swirler 48 and the inner air swirler 38. The second seal (not shown) is as described above, and is received in a channel formed by projections on the outer surface 112 if the inner air swirler 38. As with the first seal 94, the second seal includes a split so that it can expand and form a seal with the inner face 114 of the fuel swirler 48. Furthermore, an aperture (not shown) may be provided in the wall 46 of the inner air swirler 38, in a position axially behind the seal. The air in the inner air swirler 38 is at higher pressure than the air in the air gap 62, and so, in a similar manner to the aperture 110 discussed above, a pressure differential is created to prevent further ingress of fuel into the gap 62.

It will be appreciated that in some examples, the injector 30 may be provided with seals 94 in both the inner air gap 62 and the outer air gap 84. However, in other examples, only one of the air gaps 62, 84 may be provided with a seal 94. In this case, either air gap 62, 84 may have the seal 94.

In the above examples, a seal 94 is provided between a pair of concentrically arranged annular walls that form an air gap. Seals may be used in any air gap formed in this way. Furthermore, in the above examples, the seal 94 is provided in a channel 102 formed in the innermost wall defining the gap, and the seal 94 is split to expand to the outermost wall. In other examples, the channel may be formed on the outermost wall, and the seal 94 may be arranged to contract towards the innermost wall.

In the above example, the seal 94 is an O-ring seal. In other examples, any type of seal may be used, and in some cases, multiple sealing elements may be used to form the seal. For example, the seal 94 may be a double laminar back-to-back type seal.

The arrangement of the nozzle 32 discussed above is by way of example only. The sealing arrangement may be used in any suitable nozzle 32.

It will be understood that the invention is not limited to the embodiments above-described and various modifications and improvements can be made without departing from the concepts herein. Except where mutually exclusive, any of the features may be employed separately or in combination with any other features and the disclosure extends to and includes all combinations and sub-combinations of one or more features described herein.

The invention claimed is:

1. A nozzle for a fuel injector of a gas turbine engine, the nozzle comprising:

an insulating air gap adjacent a fuel conduit, the insulating air gap being formed between a pair of concentrically arranged annular walls, wherein the pair of concentrically arranged annular walls are arranged to move independently to accommodate differential thermal expansion;

a channel extending circumferentially around a surface of a first annular wall of the pair of concentrically arranged annular walls, facing a second annular wall of the pair of concentrically arranged annular walls;

a piston ring sealing member received in the channel, to close the insulating air gap, wherein the piston ring sealing member includes a split extending from an outer-most circumferential edge of the piston ring sealing member to an inner-most circumferential edge of the piston ring sealing member; and an air swirler concentrically within the fuel conduit, wherein one of the first annular wall or the second annular wall is adjacent the fuel conduit, and wherein the other of the first annular wall or the second annular wall includes an aperture extending therethrough, the aperture being located such that the piston ring sealing member is between the aperture and an outlet end of the nozzle, and wherein, during operation of the nozzle, the insulating air gap is configured to receive air from the aperture to form a pressure differential over the piston ring sealing member and the fuel conduit is configured to carry fuel.

2. The nozzle of claim 1, wherein the piston ring sealing member is biased towards the second annular wall of the pair of concentrically arranged annular walls.

3. The nozzle of claim 1, including:

an outer wall having a first radial outer face forming an exterior surface of the nozzle and a first radial inner face opposing the outer face, wherein the second annular wall is the outer wall; and an annular heat shield concentrically within the outer wall, the annular heat shield having a second radial inner face adjacent the fuel conduit and a second radial outer face opposing the second inner face and facing the outer wall, wherein the first annular wall is the annular heat shield, wherein the insulating air gap is formed between the first radial inner face of the outer wall and the second radial outer face of the annular heat shield.

4. The nozzle of claim 3, wherein the fuel conduit comprises a radial inner face concentrically within the annular heat shield, the air swirler comprises a radial outer face facing the radial inner face of the fuel conduit, and the nozzle further includes:

a second insulating air gap formed between the radial inner face of the fuel conduit and the radial outer face of the air swirler;

a second channel extending around a surface of one of the radial inner face of the fuel conduit and the radial outer face of the fuel swirler; and a second sealing member received in the channel, to close the second insulating air gap.

5. The nozzle of claim 1, wherein the fuel conduit comprises a radial inner face, and the air swirler comprises a radial outer face facing the radial inner face of the fuel conduit, wherein the insulating air gap is formed between the radial inner face of the fuel conduit and the radial outer face of the air swirler.

6. The nozzle of claim 1, including:

a pair of axially spaced annular circumferential projections extending from the first annular wall of the pair of concentrically arranged annular walls, wherein the channel is formed between the pair of axially spaced annular circumferential projections.

7. The nozzle of claim 1, including:

a feed arm for supplying fuel to the nozzle; and a feed arm support housing forming an exterior surface of the feed arm and a rearward portion of the nozzle, wherein the piston ring sealing member is provided axially forward of the feed arm housing.

8. The nozzle of claim 1, wherein the pair of concentrically arranged annular walls are formed of a first material, and the piston ring sealing member is formed of a second material, less resistant to wear than the first material.

9. An injector for a gas turbine engine, the injector having the nozzle according to claim 1.

10. The nozzle of claim 1, wherein the piston ring sealing member is configured to prevent ingress of fuel or other deposits into the insulating air gap between the pair of concentrically arranged annular walls by contacting the first annular wall of the pair of concentrically arranged annular walls and by contacting the second annular wall of the pair of concentrically arranged annular walls.

11. A nozzle for a fuel injector of a gas turbine engine, the nozzle comprising:

an insulating air gap adjacent a fuel conduit, the insulating air gap being formed between a pair of concentrically arranged annular walls, wherein the pair of concentrically arranged annular walls are arranged to move independently to accommodate differential thermal expansion;

a pair of axially spaced annular circumferential projections extending from a first annular wall of the pair of concentrically arranged annular walls;

a channel extending circumferentially around a surface of the first annular wall of the pair of concentrically arranged annular walls, facing a second annular wall of the pair of annular walls, wherein the channel is formed between the pair of axially spaced annular circumferential projections;

a sealing member received in the channel, to close the insulating air gap, wherein the sealing member includes a split extending from an outer-most circumferential edge of the sealing member to an inner-most circumferential edge of the sealing member; and an air swirler concentrically within the fuel conduit, wherein one of the first annular wall or the second annular wall is adjacent the fuel conduit, and wherein the other of the first annular wall or the second annular wall includes an aperture extending therethrough, the aperture being located such that the sealing member is between the aperture and an outlet end of the nozzle, and wherein, during operation of the nozzle, the insulating air gap is configured to receive air from the aperture to form a pressure differential over the sealing member and the fuel conduit is configured to carry fuel.

12. The nozzle of claim 11, wherein the sealing member is biased towards the second annular wall of the pair of concentrically arranged annular walls.

13. The nozzle of claim 11, including:

an outer wall having a radial outer face forming an exterior surface of the nozzle and a radial inner face opposing the radial outer face, wherein the second annular wall is the outer wall; and an annular heat shield concentrically within the outer wall and having a radial inner face adjacent the fuel conduit and a radial outer face opposing the radial inner face and facing the outer wall, wherein the first annular wall is the annular heat shield, wherein the insulating air gap is formed between the inner face of the outer wall and the radial outer face of the annular heat shield.

14. The nozzle of claim 11, including:

a feed arm for supplying fuel to the nozzle; and a feed arm support housing forming an exterior surface of the feed arm and a rearward portion of the nozzle, wherein the sealing member is provided axially forward of the feed arm housing.

15. The nozzle of claim 11, wherein the pair of concentrically arranged annular walls are formed of a first material, and the sealing member is formed of a second material, less resistant to wear than the first material.

16. A nozzle for a fuel injector of a gas turbine engine, the nozzle comprising:

an insulating air gap adjacent a fuel conduit, the insulating air gap being formed between a pair of concentrically arranged annular walls, wherein the pair of concentrically arranged annular walls are arranged to move independently to accommodate differential thermal expansion;

a channel extending circumferentially around a surface of a first annular wall of the pair of concentrically arranged annular walls, facing a second annular wall of the pair of concentrically arranged annular walls;

a sealing member received in the channel, to close the insulating air gap, wherein the sealing member includes a split extending from an outer-most circumferential edge of the sealing member to an inner-most circumferential edge of the sealing member; and an air swirler concentrically within the fuel conduit, wherein one of the first annular wall or the second annular wall is adjacent the fuel conduit, and wherein the other of the first annular wall or the second annular wall includes an aperture extending therethrough, the aperture being located such that the sealing member is between the aperture and an outlet end of the nozzle, and wherein, during operation of the nozzle, the insulating air gap is configured to receive air from the aperture to form a pressure differential over the sealing member and the fuel conduit is configured to carry fuel.

* * * * *